US009869180B2

(12) United States Patent
Ureel

(10) Patent No.: US 9,869,180 B2
(45) Date of Patent: Jan. 16, 2018

(54) ENERGY HARVESTING HEAT ENGINE AND ACTUATOR

(71) Applicant: Synergy Power LLC, Holland, MI (US)

(72) Inventor: Emil J. Ureel, Holland, MI (US)

(73) Assignee: Synergy Power, LLC, Holland, MI (US)

( * ) Notice: Subject to any disclaimer, the term of this patent is extended or adjusted under 35 U.S.C. 154(b) by 134 days.

(21) Appl. No.: 15/088,991

(22) Filed: Apr. 1, 2016

(65) Prior Publication Data

US 2016/0290136 A1 Oct. 6, 2016

Related U.S. Application Data

(60) Provisional application No. 62/178,211, filed on Apr. 3, 2015.

(51) Int. Cl.

| | |
|---|---|
| ***F01B 13/06*** | (2006.01) |
| ***F02G 1/043*** | (2006.01) |
| *F01B 15/00* | (2006.01) |

(52) U.S. Cl.

CPC ..... *F01B 13/068* (2013.01); *F02G 1/043* (2013.01); *F01B 15/005* (2013.01)

(58) Field of Classification Search

CPC ..... F01B 13/068; F01B 15/005; F02G 1/044; F02G 1/0535; F02G 2253/00; F02G 2253/08; F02G 2253/10; F02G 2270/40

See application file for complete search history.

(56) References Cited

U.S. PATENT DOCUMENTS

| | | | | |
|---|---|---|---|---|
| 4,122,756 | A * | 10/1978 | Grundmann | F01B 1/02 417/473 |
| 4,414,814 | A * | 11/1983 | White | F02G 1/043 60/508 |
| 5,337,563 | A * | 8/1994 | Weber | F02G 1/043 60/520 |
| 9,752,532 | B2 * | 9/2017 | Kamen | F02G 1/0435 |
| 2008/0226468 | A1 * | 9/2008 | Jackson | B65B 3/12 417/53 |
| 2012/0073298 | A1 | 3/2012 | Frem | |

* cited by examiner

*Primary Examiner* — Jonathan Matthias

(74) *Attorney, Agent, or Firm* — The Watson I.P. Group PLC; Jovan N. Jovanovic; Vladan M. Vasiljevic

(57) ABSTRACT

A rotary heat engine including a central crankshaft and a plurality of cylinder assemblies and a heat exchanger assembly. At least one of the plurality of cylinders, and preferably all of the plurality of cylinders includes a cylinder member, a piston member slidably positionable within the cylinder member, a connecting rod and a rolling diaphragm. The rolling diaphragm is positioned between the piston and the cylinder assembly to define a working volume which is in fluid communication with an opening that is in communication with the heat exchanger body.

16 Claims, 11 Drawing Sheets

ENERGY HARVESTING HEAT ENGINE AND ACTUATOR

CROSS-REFERENCE TO RELATED APPLICATION

The present application claims priority from U.S. Provisional Patent Application Ser. No. 62/178,211 filed Apr. 3, 2015, entitled "Energy Harvesting Heat Engine And Actuator," the entire specification of which is hereby incorporated by reference in its entirety.

BACKGROUND OF THE DISCLOSURE

1. Field of the Disclosure

The disclosure relates in general to an energy harvesting heat engine and actuator, and more particularly, to an energy heat engine that can take advantage of a temperature difference between two adjacent regions, turning the temperature difference into mechanical movement, which, in turn, can be converted into other types of energy or power, such as, for example electrical power.

2. Background Art

As the world's demands for energy increases, new ways of harnessing energy are needed. Current Heat Engines such as the Rankine cycle require some sort of circulation pump for the working fluid, which adds expense and consumes energy lowering overall efficiency; or a displacer in the case of some Sterling Engine topologies. Also, the invention does not transfer the working fluid between two connected different temperature containers and/or heat exchangers as in the case of the Alpha Sterling Engine topology. The Heat Engine described in the application does not require a circulating pump for the working fluid, and unlike the Sterling Engine, which uses a single-phase working fluid; the working fluid can be a refrigerant in the saturated vapor-liquid state for low temperature operation.

The Heat Engine described does not use up any of the working fluid. The working fluid is completely contained and recycled. The Heat Engine described transfers energy from an external heat source into mechanical energy. The Heat Engine described is closed cycled, and does not use any form of internal combustion and therefore it does not emit any exhaust. The Heat Engine described can harness heat from conduction, convection, and/or radiation.

Potential applications include, but are not limited to, harnessing energy from a solar water heater, from waste heat, from a naturally occurring thermocline, artificially created thermocline, from a salt pond thermocline, heat from chemical reactions, heat from electrical power, geothermal sources, conventional fuels such as coal, natural gas, nuclear, direct solar radiation on the ground or in space.

Certain solutions have been proposed for such engines. One such solution is shown in U.S. Pat. App. Pub. No. 2012/0073298 published to Frem. Problematically, the construction shown suffers from several drawbacks, some of which are set forth herein. First, the manner in which the refrigerant is maintained leads to substantial liquid refrigerant within the cylinder over time, generally regardless of the angle and orientation of the crankshaft. Second, there is no control of heat transfer between the heat exchanger and the cylinders themselves, resulting in fluctuating temperatures and heat transfer from both the outside and the inside refrigerant to the cylinder. Third, the bending movements introduced by the piston movement transferred to rotational movement lead to losses and stresses within the piston, cylinder and connecting rod.

SUMMARY OF THE DISCLOSURE

The disclosure is directed to a rotary heat engine. The rotary heat engine comprises a central crankshaft, a plurality of cylinder assemblies and a heat exchanger associated therewith. The central crankshaft has a first end and a second end and defining an axis of rotation. The central crankshaft further includes at least one piston attachment member having an offset axis which is offset from the axis of rotation, with at least one axially displaced coupling point about the offset axis. At least one of the plurality of cylinder assemblies (and preferably all of the cylinder assemblies) include a cylinder member, a piston member, a connecting rod and a rolling diaphragm. The cylinder member has an elongated structure defining a bore and including a top end and a bottom end. The cylinder member is rotatably positioned about the central crankshaft so as to rotate about the axis of rotation. The cylinder member further includes an opening proximate the top end. The piston member is slidably positionable within the bore. The connecting rod has a piston coupling end coupled to the piston member and a distal end coupled to the at least one axially displaced coupling point of the at least one piston attachment member. The rolling diaphragm is positioned between the piston and the top end so as to define a working volume therebetween. The rolling diaphragm has a top end, a bottom panel and an elongated portion. The top end is sealingly attached to the cylinder member proximate the top end and in fluid communication with the opening therein. The bottom panel overlays the piston so that movement of the piston rolls the elongated portion of the rolling diaphragm over itself between the piston and the bore of the cylinder member. The heat exchanger assembly is associated with the at least one cylinder assembly, and includes a heat exchanger body and a connecting pipe. The heat exchanger body includes an outer surface and an inner chamber. The heat exchanger body has a refrigerant positioned within the inner chamber. The connecting pipe has an inner bore, a heat exchanger end and a cylinder member end. The heat exchanger end is coupled to the heat exchanger body, and the cylinder member end is coupled to the opening in the cylinder member, thereby placing the inner chamber in fluid communication with the opening of the cylinder member, and the working volume of the rolling diaphragm through the opening.

In some configurations, at least a portion of the inner chamber of the heat exchanger body remains below the opening in the cylinder member, to in turn, preclude the passage of at least some refrigerant in a liquid state from the inner chamber to the working volume.

In some such configurations, the at least a portion of the inner chamber of the heat exchanger body that remains below the opening in the cylinder member is larger than a volume of refrigerant in a liquid state within the inner chamber.

In some configurations, the heat exchanger body comprises a first material and the connecting pipe comprises a second material. The first material is more conductive to heat than the second material.

In some configurations, the heat exchanger body is configured to transfer heat faster the closer the liquid refrigerant is to the heat exchanger end of the connecting pipe.

In some configurations, the cylinder member further comprises a distal end wall at the top end of the elongated structure. The top end of the rolling diaphragm is sandwiched between the distal end wall and the top end of the elongated structure in sealed engagement. Additionally, the opening of the cylinder member extends through the distal end wall.

In some configurations, the rolling diaphragm comprises a neoprene material.

In some configurations, the distal end wall includes an insulation member positioned on an inner surface thereof.

In some configurations, insulation is positioned over at least a portion of an outer surface of the distal end wall and at least a portion of an outer surface of the elongated member.

In some configurations, the piston member is smaller than the bore such that when the rolling diaphragm is positioned between the piston member and the bore of the cylinder member. The piston member is capable of pivoting relative to the bore, to, in turn, allow the connecting rod to pivot relative to the bottom end of the elongated structure of the cylinder member.

In some configurations, the piston coupling end is rigidly coupled to an outer surface of the piston.

In some configurations, the piston member of at least one of the plurality of cylinder assemblies is fixed to the respective at least one coupling point to preclude relative rotation therebetween.

In some configurations, each of the plurality of cylinder assemblies is substantially identical, with one of the plurality of cylinder assemblies being fixed to the respective at least one coupling point to preclude relative rotation therebetween.

In some configurations, a radial cylinder coupling is rotatably fixed to the central crankshaft so as to rotate about the axis of rotation, with each of the plurality of cylinders.

In some configurations, each of the plurality of cylinder assemblies are maintained in a same plane, which plane is perpendicular to the axis of rotation.

In some configurations, the plurality of cylinder assemblies comprises an uneven number of cylinder assemblies, spaced substantially uniformly about the piston attachment member.

BRIEF DESCRIPTION OF THE DRAWINGS

The disclosure will now be described with reference to the drawings wherein.

DETAILED DESCRIPTION OF THE DISCLOSURE

Figure 1:
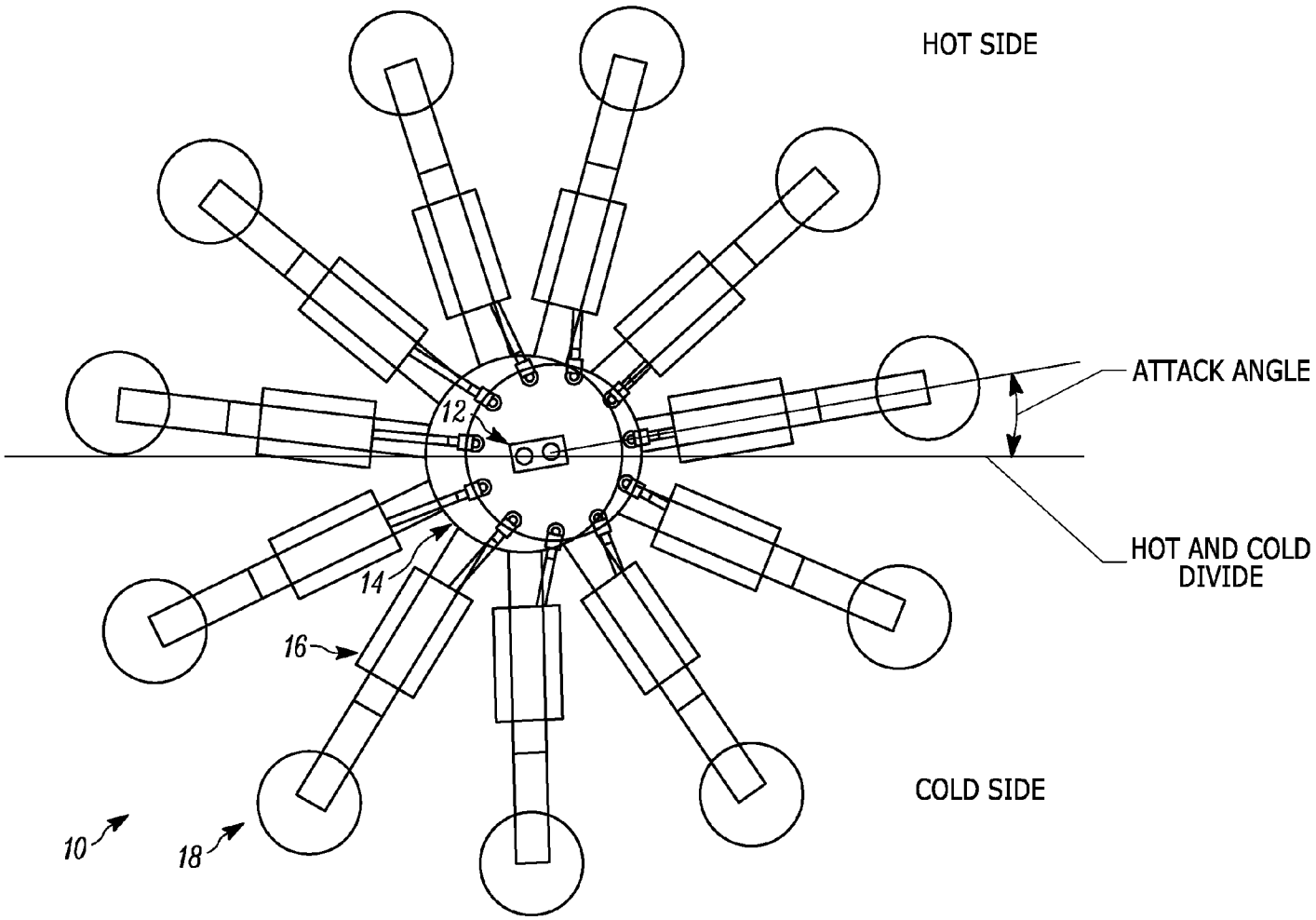
FIG. 1 of the drawings is a schematic top plan view of a configuration of the rotary heat engine of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
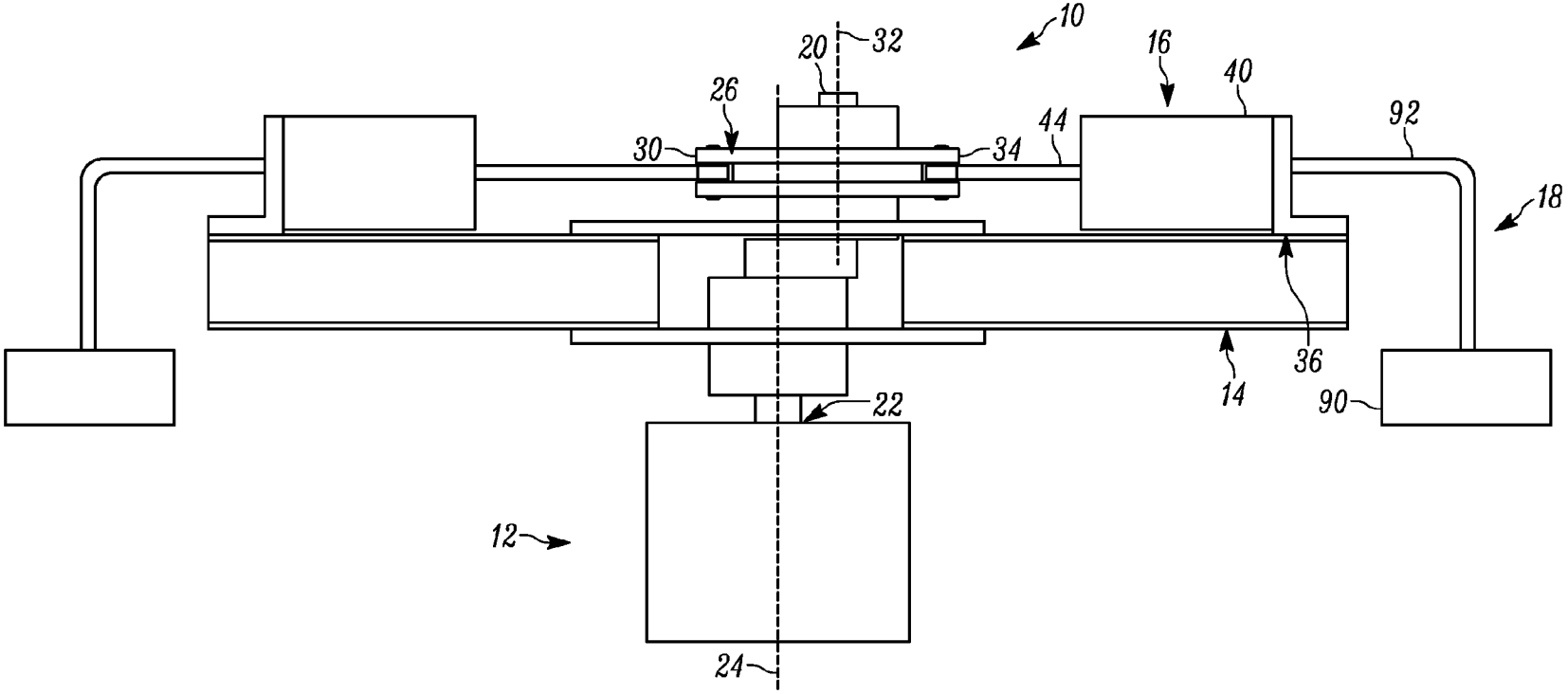
FIG. 2 of the drawings is a schematic side elevational view of the configuration of the rotary heat engine of the present disclosure that is shown in FIG. 1.

Referring now to the drawings and in particular to FIGS. 1 and 2, the rotary heat engine is shown generally at 10. As will be explained, the rotary heat engine is essentially powered by the phase change and expansion of gasses within a sealed working volume and heat exchanger, due to a change in temperature experienced by portions of the heat engine. In the preferred configuration, although not required, the rotary heat engine is configured to have a plurality of cylinders arranged in a rotary configuration with a heated side and a cooled side opposite the heated side. The rotary heat engine can be utilized to create electrical power through the coupling with a generator or an alternator or other mechanical to electrical converting device. The generated electrical power can be used or supplied back to a utility. The rotary heat engine is not limited to the configuration shown, and is not limited to any particular field of use or application, or, limited to the generating of electrical energy. It is contemplated that the rotary heat engine can be utilized in place of other mechanisms, systems and equipment for the generation of electrical energy or for the generation of mechanical energy.

The rotary heat engine 10 is shown in FIGS. 1 and 2 as comprising central crankshaft 12, radial cylinder coupling 14, cylinder assembly 16 and heat exchanger assembly 18. In the configuration shown, the central crankshaft 12 is shown as being substantially vertical. It will be understood that in other configurations, the central crankshaft may be oblique so as to be neither vertical nor horizontal. In still further configurations, the central crankshaft may be substantially horizontal. The central crankshaft 12, in the configuration shown, has a first end 20 and a second end 22. The first end, in the configuration shown, is at the top with the second end at the bottom. The central crankshaft further includes an axis of rotation 24 that may be in a vertical orientation, a horizontal orientation or an oblique orientation, as explained above. Depending on the size of the rotary heat engine, the height, and the thickness of the central crankshaft will be varied so as to be able to take the loads that are applied thereto by the multiple cylinder assemblies that are coupled thereto.

Figure 3:
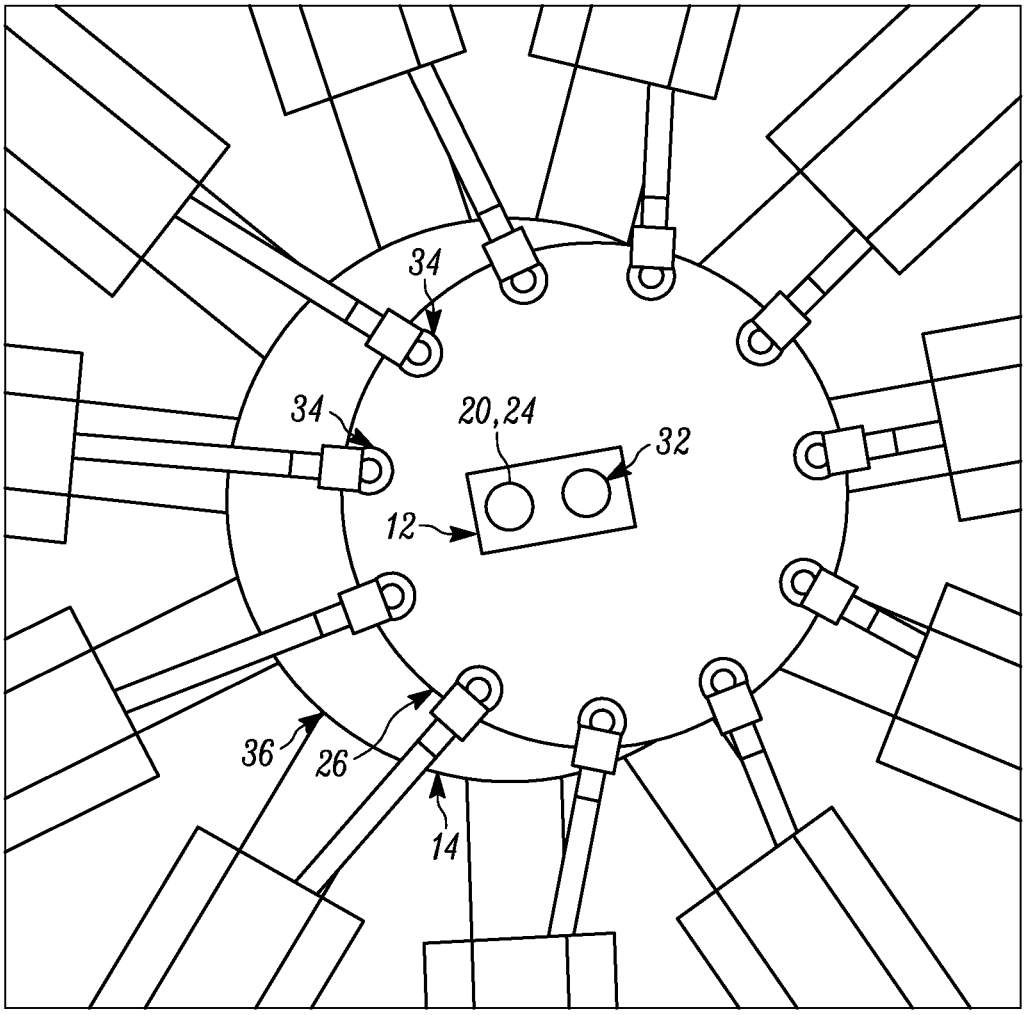
FIG. 3 of the drawings is a partial schematic top plan view of the central crankshaft with the radial cylinder coupling and the connecting rods coupled thereto.

With further reference to FIG. 3, the central crankshaft 20 further includes at least one piston attachment member, such as piston attachment member 26. The piston attachment member 26, in the configuration shown, comprises a planar member having an outer perimeter 30, an offset axis 32 and a plurality of axially displaced cylinder assembly coupling points, such as coupling point 34. In the configuration shown, the piston attachment member 26 is in a plane that is perpendicular to the axis of rotation 24 of the central crankshaft 12. In other configurations, it is contemplated that the piston attachment member 26 may be oblique thereto. In addition, in the configuration shown, the piston attachment member has a substantially circular outer perimeter centered about the offset axis 32 which is offset a predetermined distance from the axis of rotation 24. In turn, each of the coupling points 34 are spaced apart radially proximate the outer perimeter 30 of the piston attachment member 26 so that they are generally equidistant from the offset axis 32. As such, it is contemplated that the cylinder assemblies are generally positioned in the same plane relative to each other, and generally in the same plane (or a parallel plane) as the piston attachment member 26.

It is contemplated that the cylinder assemblies may be positioned in different planes, and that there may be more than one piston attachment member. That is, there may be a separate piston attachment member for a group of cylinders, or a separate piston attachment member for each cylinder. In still other configurations, the central crankshaft may include lobes or bends which may define a piston attachment member, these may be in different planes for each cylinder, or may provide a coupling for multiple cylinders. Thus, the central crankshaft may have the appearance of a generally uniform rod-like member with a plurality of bends or lobes along the length thereof. The purpose of the central crankshaft is to take the generally linear movement of the cylinder assemblies and convert the same to a rotative movement. It is contemplated that there are a number of different variations to achieve the same.

The radial cylinder coupling 14 is shown in the configuration of FIGS. 1 and 2 as comprising a hoop-like member to which components of the cylinder assembly are coupled, at, for example, attachment points 36. The hoop-like member is coupled, directly or indirectly, to the central crankshaft so as to have an axis of rotation that corresponds to the axis of rotation 24 and it is spaced apart from the piston attachment member 26, and in particular, the outer perimeter 30 thereof. The hoop-like member is preferably in a parallel plane to the piston attachment member 26 of the central crankshaft (and in some configurations, the radial cylinder coupling may comprise multiple interacting structures that are in independent and different planes). In the configuration shown, and as will be discussed below, each one of the cylinder members are coupled to an attachment point 36 of the hoop-like member. In the configuration shown, the cylinder members are fixedly attached to the attachment points, whereas in other configurations, the cylinder members can be pivotably or rotatably or flexibly coupled to the radial cylinder coupling 14, which allows for some relative movement of the cylinder member vis-à-vis the radial cylinder coupling. It is further contemplated that for some designs, the cylinder members can be integrally formed with the radial cylinder coupling. In still other configurations, especially wherein the cylinder assemblies are in different planes, it is contemplated that there may be a plurality of radial cylinder couplings. It is further contemplated that while the radial cylinder coupling is shown as having the cylinder members extend radially outwardly therefrom, other configurations, wherein the radial cylinder coupling is further inboard or outboard relative to the cylinder members, are likewise contemplated.

Figure 4:
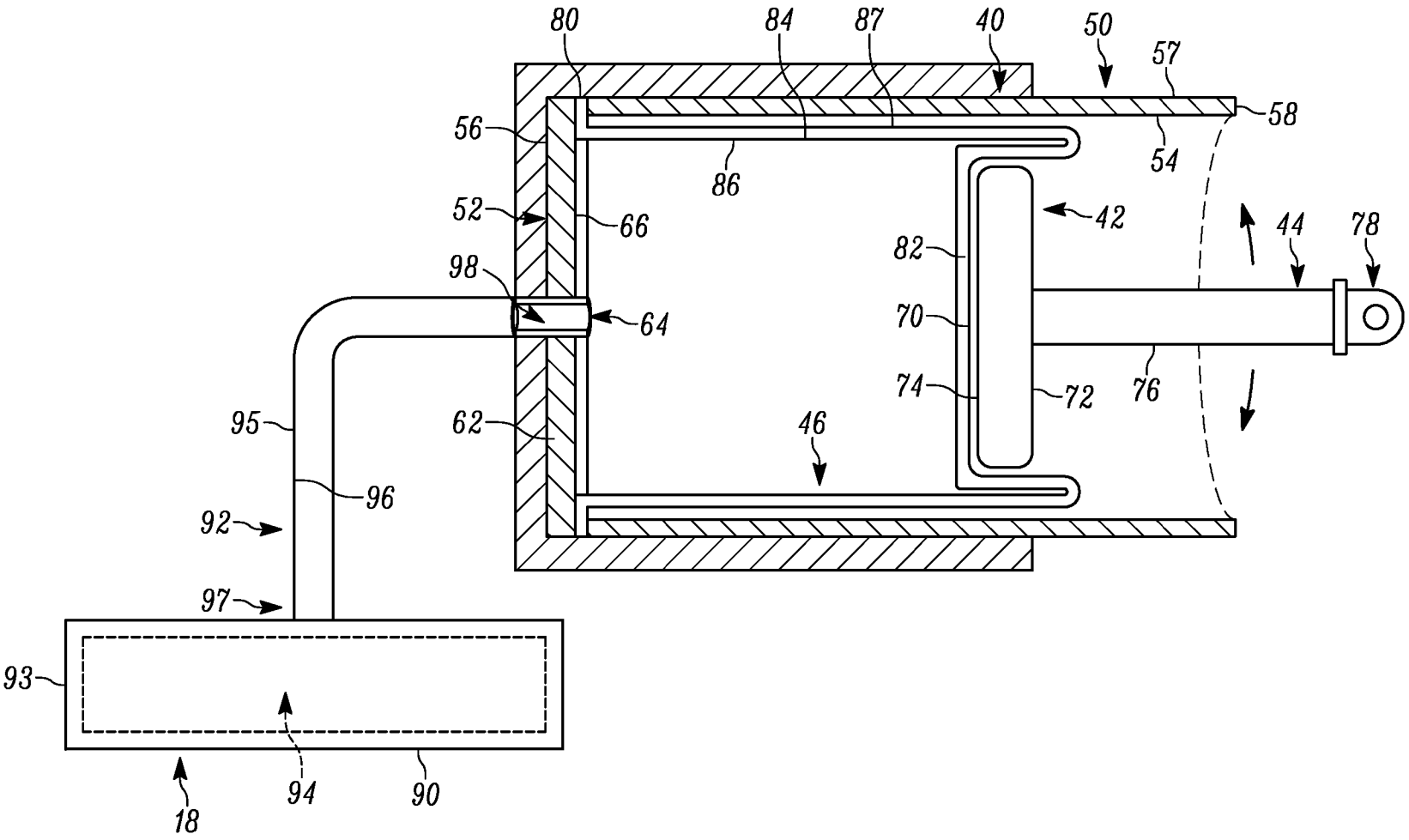
FIG. 4 of the drawings is a schematic cross-sectional view of a cylinder assembly and heat exchanger assembly of the present disclosure.

The cylinder assembly 16 is shown in greater detail in FIG. 4 as comprising cylinder member 40, piston member 42, connecting rod 44 and rolling diaphragm 46. In the configuration shown, there are a plurality of cylinder assemblies, each of which are coupled by way of the cylinder member to the radial cylinder coupling 14 and spaced apart from each other therealong. In the configuration shown, the piston member 42 of each of the cylinder assemblies is coupled to the piston attachment member 26 of the central crankshaft 12 (FIGS. 1 and 3).

The cylinder member 40 is shown as comprising elongated structure 50 and distal end wall 52. The elongated structure 50 includes inner surface 54 that defines inner chamber (i.e., also often known as the cylinder bore) and outer surface 57 extending therearound. The elongated structure has top end 56 and bottom end 58 and generally comprises a substantially uniform cylindrical cross-section, although other configurations are contemplated (including, but not limited to, oval, elliptical, rectangular, polygonal). In some configurations, portions along which the piston travels may be substantially uniform in cross-section, with other portions being of a different cross-sectional configuration.

The distal end wall 52 is positioned at the top end 56 of the elongated structure 50 and includes inner surface 60, outer surface 62 and opening 64. In the configuration shown, the distal end wall 52 comprises a substantially planar member that is substantially perpendicular to a central axis of the elongated structure 50, although variations, such as hemispherical or otherwise, are also contemplated. The opening 64, in the configuration shown, is positioned so as to substantially correspond to the central axis of the elongated structure 50. In other configurations, the opening 64 may be offset so as to be closer to the inner surface 54 of the elongated structure. In other configurations, the opening 64 may comprise a plurality of openings that are spaced apart from each other along the distal end wall. In still other configurations, the opening 64 may be formed in the elongated structure proximate the top end. It is further contemplated that in some configurations, a conical structure or an outwardly convex structure may form the distal end wall, which structure may include one or more openings extending thereon.

Figure 6:
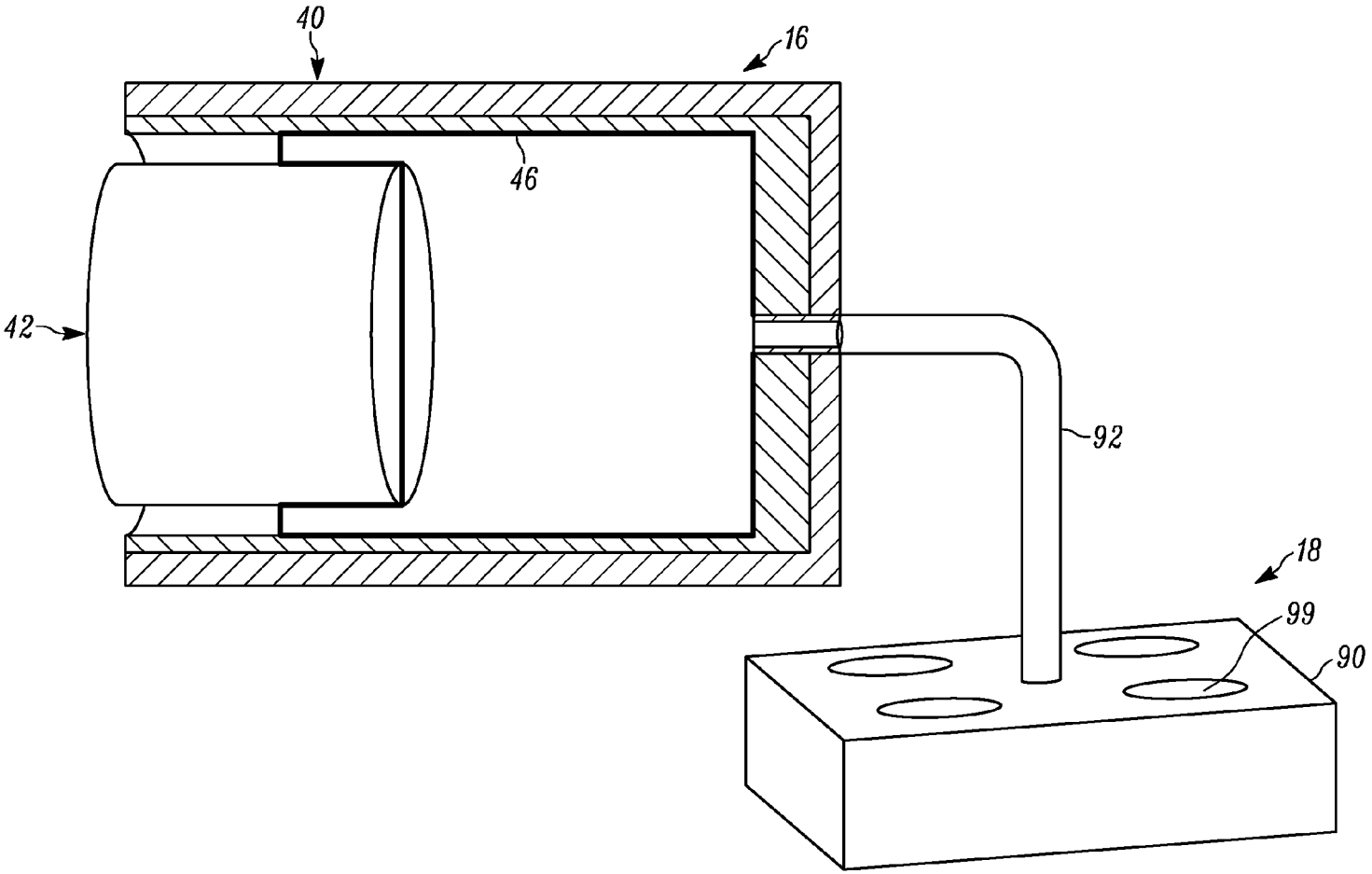
FIG. 6 of the drawings is a partial schematic cross-sectional view of a configuration of the cylinder assembly and heat exchanger assembly, showing the relative position of the heat exchanger relative to the cylinder assembly wherein the cylinder assembly is oriented substantially horizontally (and the central crankshaft is oriented substantially vertically), and showing insulation extending about the outside of the cylinder member, and along the inside surface of the distal end wall.

The outer surface 57 of the elongated structure 50 and the outer surface 62 of the distal end wall may both include an insulation extending thereover, as is further shown in FIG. 6. Such insulation may comprise a sprayed-on insulation, a blanket or other flexible insulation, rigid insulation that is adhered or otherwise generally coupled (through an interference fit or the like) to the outer surfaces. Such insulation limits that temperature variation of the cylinder assembly so as to minimize the temperature fluctuation of the cylinder assembly (thereby improving the control of the refrigerant that is utilized therewith).

It is contemplated that the bottom end 58 of the elongated structure 50 of the cylinder member 40 may be open. Such a configuration allows for the relative movement of the connecting rod bounded only by the bottom end 58 of the elongated structure 50. In other configurations, a bottom end wall or the like may be employed with an opening configured to allow for the connecting rod to pass therethrough. In some such configurations, a linear bearing or the like may be provided, which linear bearing may be capable of pivoting.

The piston member 42 is shown in FIG. 4 as comprising inner surface 70, outer surface 72 and side interfacing surface 74. The piston member 42 is configured to be slidably positionable along the elongated structure 50 between the top end and the bottom end thereof, with the understanding that the actual movement of the piston from its closest position relative to the bottom end and the closest position relative to the top end being defined as the stroke. The inner surface 70 generally faces the top end 56 with the outer surface 72 facing the bottom end 58.

The connecting rod 44 includes piston coupling end 76 and distal end 78. In the configuration shown, the piston coupling end 76 is generally coupled to a centrally located portion of the outer surface 72 of the piston member. The distal end 78 may be pivotably or fixedly coupled to the piston attachment member 26 of the central crankshaft (FIG. 3). Depending on the cylinder assembly, and the configuration, it is often the case that one cylinder assembly will have a distal end that is fixedly coupled to the piston attachment member, whereas the others are pivotably coupled thereto.

Furthermore, it is contemplated that the piston coupling end 76 is fixedly coupled to the outer surface 72 of the piston member. In other configurations, however, it is contemplated that the piston coupling end is pivotably coupled to the outer surface 72 of the piston member (through a pivoting coupling configuration, or through a ball and socket type joint for example), so as to allow the connecting rod 44 some angular displacement relative to the outer surface 72 of the piston member.

The rolling diaphragm 46 is shown in FIG. 4 as comprising top end 80, bottom panel 82 and elongated portion 84. The rolling diaphragm essentially surrounds or forms the inner wall of the expansion and contraction chamber within the cylinder assembly. The top end 80 is typically coupled proximate the top end 56 of the elongated structure. In the contemplated configuration, the top end 56 is sandwiched between the top end 56 of the elongated structure and the inner surface 60 of the distal end wall 52. The elongated portion 84 extends along the inner surface 54 and can be shape matingly configured so as to match the inner surface. The bottom panel is configured to extend across the bore and be generally coupled to or to overlie the inner surface 70 of the piston member 42. In the configuration shown, as the piston slides toward and away from the top end 56 of the elongated structure, a portion of the elongated portion 84 of the rolling diaphragm will fold over itself with the piston traversing inside thereof. As such, the rolling diaphragm forms an impervious bladder or the like to contain the gasses within the elongated structure between the distal end wall and the piston member, and define a working volume.

In the configuration shown, the rolling diaphragm comprises a neoprene material that is of very low friction (when folded over itself between the piston and the inner surface of the elongated structure of the cylinder member) and also impervious to the gasses that are contemplated for use. Such a rolling diaphragm is likewise suitable for use at elevated pressures, such as, for example, pressures of the likes of 200 psi. Of course, modifications can be made to the properties of the rolling diaphragm to accommodate higher or lower pressures, and the disclosed pressures are merely exemplary and not to be deemed limiting.

The rolling diaphragm further forms an insulative layer along the inner surface of the cylinder. In some configurations, it is contemplated that an additional layer of insulation may be positioned on the inner surface of the distal end wall 52 of the cylinder member. In other configurations, the rolling diaphragm may have a configuration that extends over the distal end wall 52 with an opening that is fixedly positioned about the opening 64 of the distal end wall 52. In still other configurations, the rolling diaphragm may have its top end 80 spaced apart from the distal end wall 52, for example, so that it is limited to the stroke of the piston, with, for example, different insulation between the top end of the rolling diaphragm and the distal end wall 52. One such rolling diaphragm and cylinder member configuration can be purchased from Illinois Pneumatic of Roscoe, Ill.

Figure 5A:
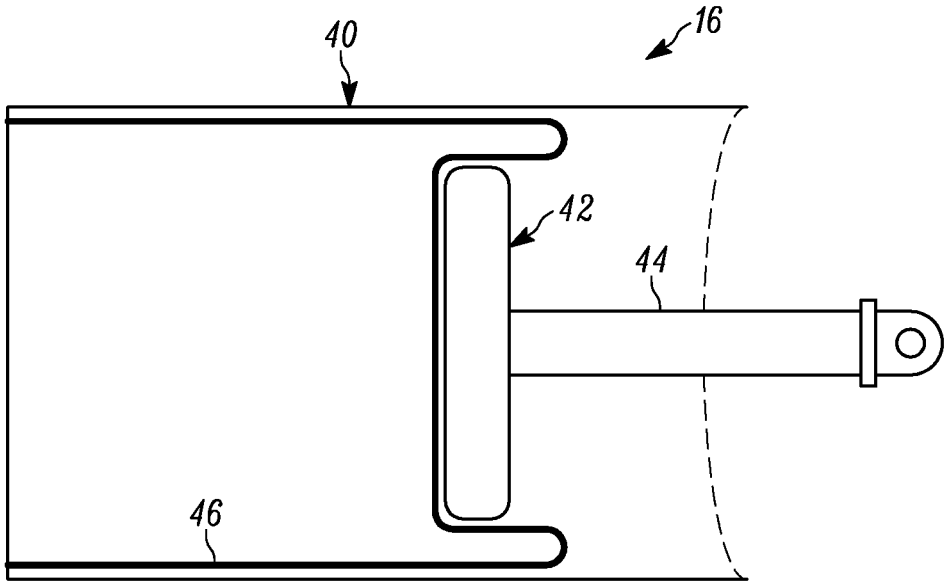
FIGS. 5*a* through 5*c* of the drawings are schematic cross-sectional views of a cylinder assembly of the present disclosure, showing, in particular, the pivoting of the piston and the connecting rod within the bore of the cylinder member.
Figure 5B:
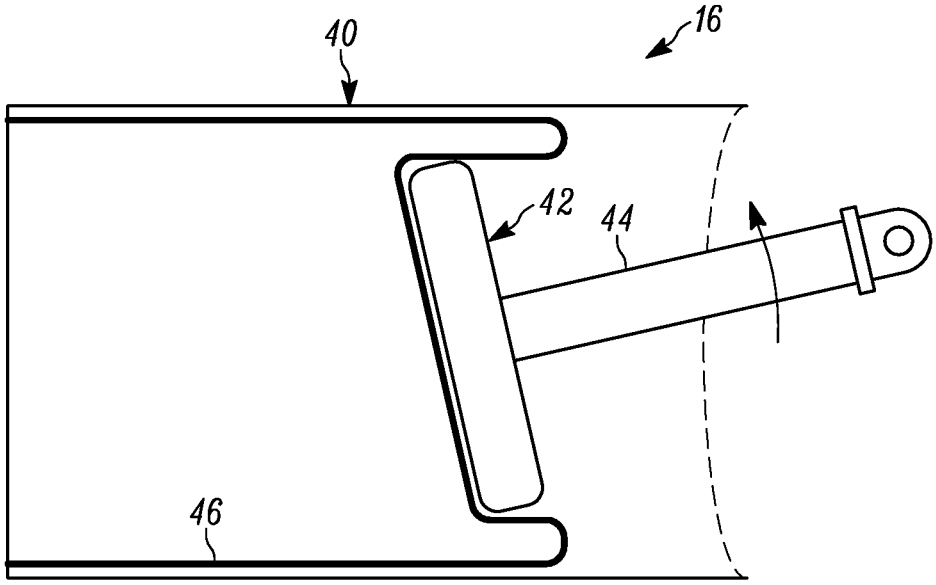
Figure 5C:
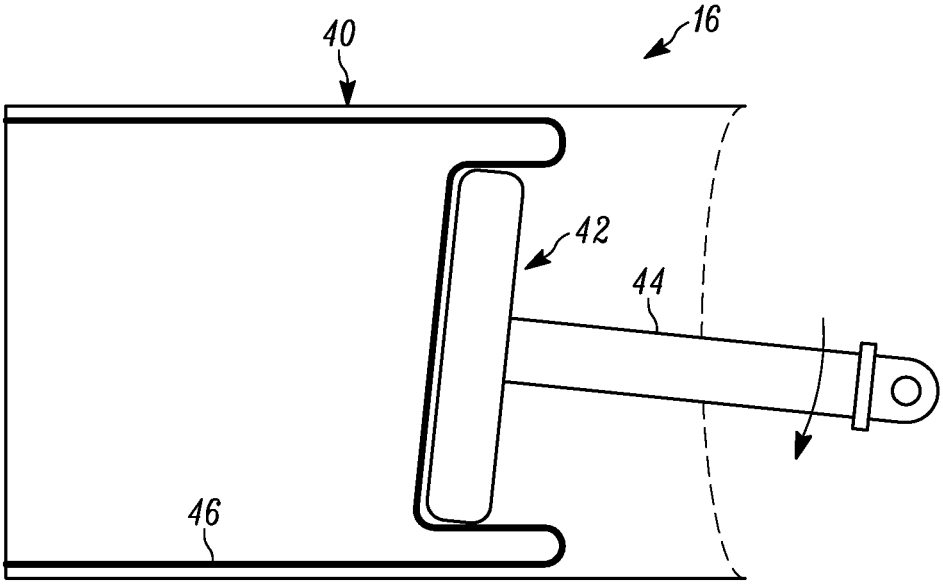

With additional reference to FIGS. 5*a* through 5*c*, with the use of the rolling diaphragm, the piston size is smaller than if there was no rolling diaphragm, as there may be multiple layers of the rolling diaphragm between the piston and the inner surface of the elongated structure of the cylinder member. Advantageously, this allows the piston to float within the cylinder member, combined with the flexibility of the rolling diaphragm, the piston can rotate within the cylinder member (FIGS. 5*b* and 5*c*), which results in a larger displacement of the distal end of the connecting rod. For a rotary engine, a bending moment is typically created by the back and forth pivoting of a piston as the engine spins around a fixed axis. Often, a pivot point is created, which is configured to pivot or bend to compensate for the bending movement. Problematically, these can be areas of high stress, and these can be detrimental to efficiency. By allowing the piston to float relative to the cylinder member, the bending movement is compensated through pivoting and rotation of the piston member. This also allows for direct coupling of the connecting rod to the piston attachment member of the central crankshaft. It will be understood that the connecting rods can be increased to limit the amount of required pivoting, among other geometric changes to the offset axis and the like.

The heat exchanger assembly 18 is shown in FIG. 4 as comprising heat exchanger body 90 and connecting pipe 92. The heat exchanger 90 is positioned proximate the cylinder member with the connecting pipe 92 extending between the heat exchanger 90 and the cylinder member (and in the configuration shown, the opening 64 in the distal end wall 52 of the cylinder member).

In more detail, the heat exchanger body 90 includes outer surface 93 and inner chamber 94. Preferably, the heat exchanger body is formed from a material that is generally low mass and highly thermally conductive. One such example would be a heat exchanger body formed from copper or an alloy thereof. Of course, this is not to be deemed limiting, but only exemplary. The heat exchanger body, in the configuration shown may comprise a coiled pipe in some configurations. In other configurations, a cylindrical member having large top and bottom surfaces with a side surface therebetween is contemplated for use. Such a configuration may include passageways, such as passageways 99, to facilitate a greater surface area for contact with the heating and cooling sources, so as to improve the performance thereof. In other configurations, a cubic member having relative large top and bottom surfaces with smaller side surfaces is contemplated. Again, passageways 99 (FIG. 6) may extend therethrough to facilitate heat transfer. Of course other configurations are likewise contemplated. Preferably, the surface area of the body is relatively large for the volume of the inner chamber, which improves performance.

The connecting pipe is shown in FIG. 4 as including outer surface 95, inner bore 96, heat exchanger end 97 and cylinder member end 98. In the configurations shown, the connecting pipe comprises a pipe of a substantially uniform configuration (which may be bent along the length thereof). The inner bore is therefore generally uniform, although variations are contemplated. Preferably, the connecting pipe is of a material that is insulative, or is coated with an insulation, such that the effects of the outside heating and cooling sources can be minimized. The heat exchanger end 97 is coupled to the heat exchanger so that the inner bore is in fluid communication with the inner chamber 94 of the heat exchanger body.

Figure 7:
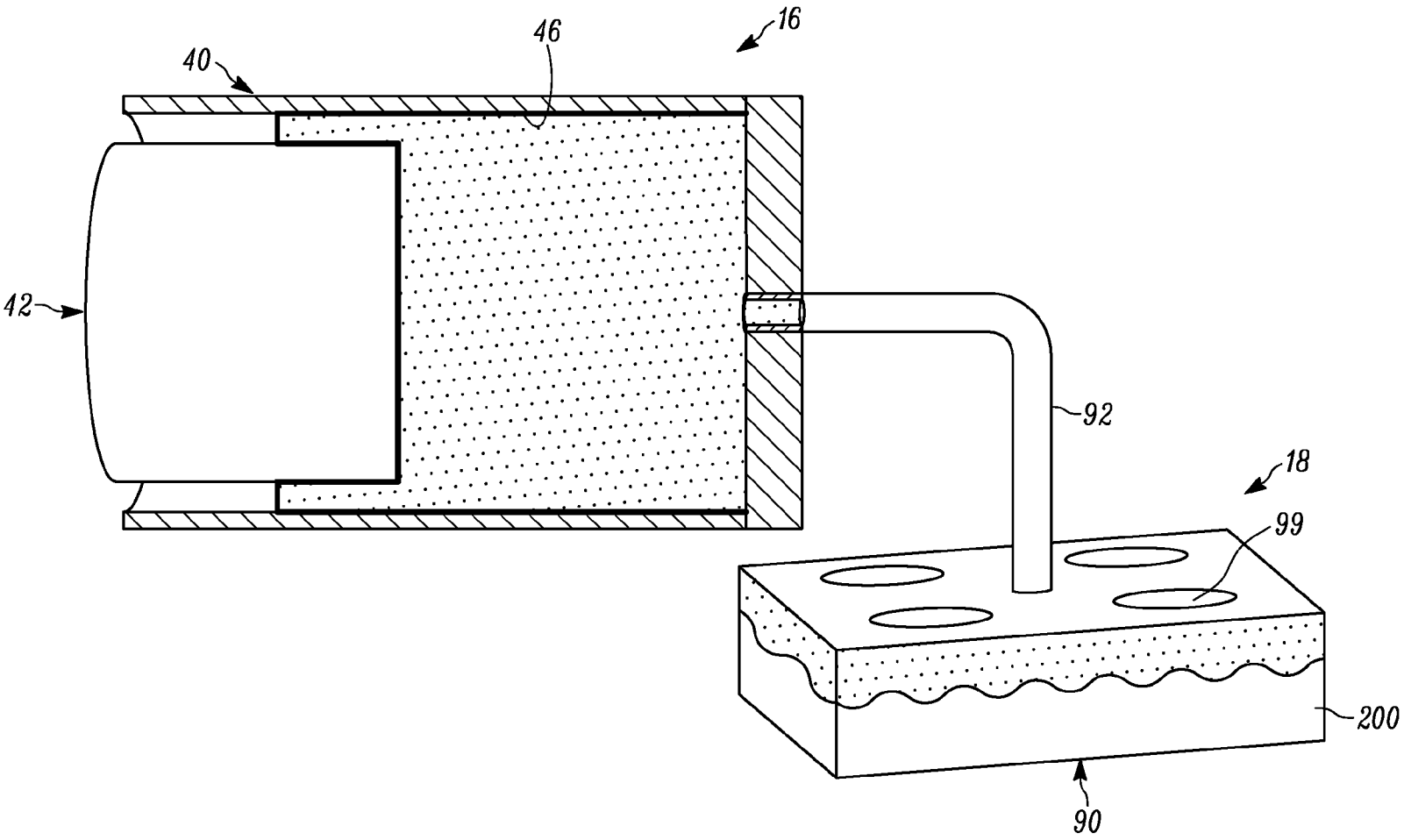
FIG. 7 of the drawings is a partial schematic cross-sectional view of the configuration of FIG. 6, showing the liquid and gas refrigerant within the heat exchanger and the cylinder member (and in particular the working volume defined by the rolling diaphragm)
Figure 8:
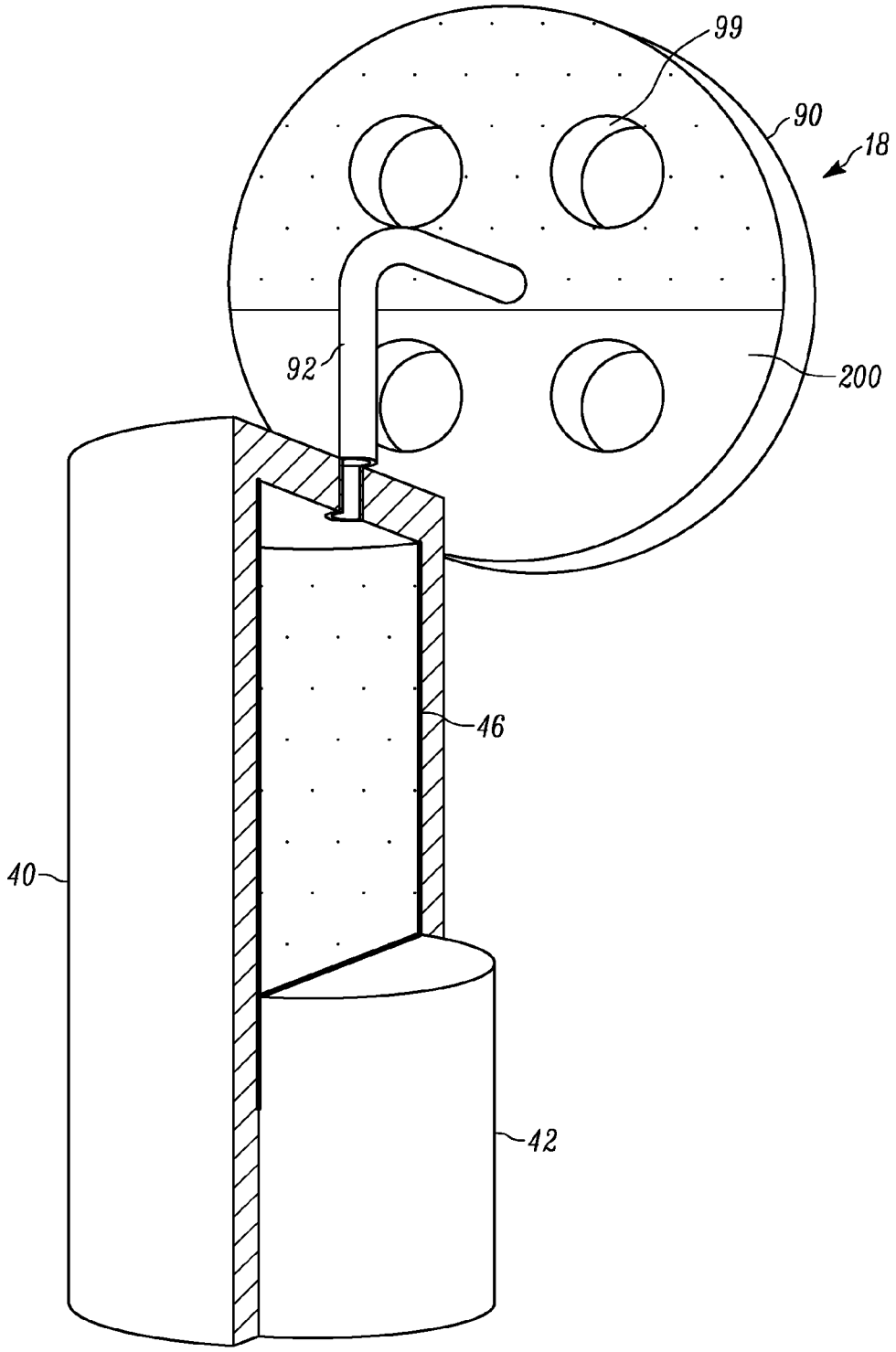
FIG. 8 of the drawings is a partial schematic cross-sectional view of a configuration of the cylinder assembly and heat exchanger assembly, showing the relative position of the heat exchanger relative to the cylinder assembly wherein the cylinder assembly is oriented substantially vertically (and the central crankshaft is oriented substantially horizontally), when the cylinder assembly is in the top position during rotation.
Figure 9:
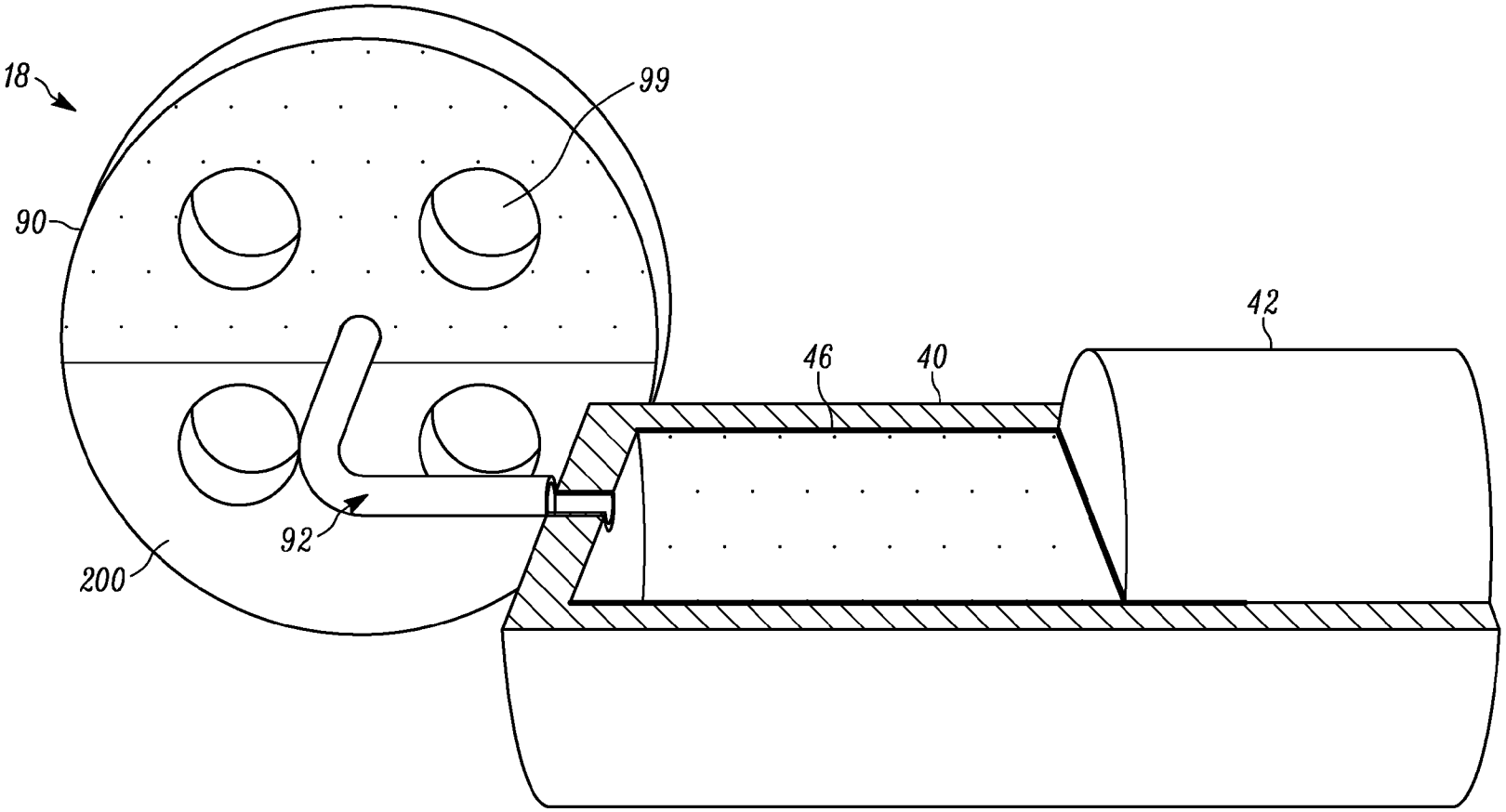
FIG. 9 of the drawings is a partial schematic cross-sectional view of the configuration shown in FIG. 8, when the cylinder is in a horizontal orientation along its rotative travel about the central crankshaft.

As can be seen in FIGS. 7 through 9, it is contemplated that the connecting pipe is coupled to the heat exchanger body in such a configuration that, with the aid of gravity and the like, the refrigerant 200 that remains in a liquid state generally remains in the heat exchanger body and its passage through the connecting pipe and into the cylinder member is minimized. In some configurations, the connecting pipe may be pivotably coupled to the cylinder member, so that relative rotation is permitted. In such a configuration, through the force of gravity and the like, the coiled hose heat exchanger body can remain in a position that substantially precludes the passage of liquid refrigerant into the cylinder body.

It will be understood that a number of different refrigerants can be utilized for the refrigerant 200. In some configurations a hydrofluorocarbon (HFC) refrigerant such as R134 may be utilized. A number of other refrigerants are also contemplated including different CFC, CFO, HCFC, HCFO, HFC, HFO, HCC, HCO, HC, HO, and other refrigerant types. It has been found that R134 can be utilized with effective results. However, the disclosure is not limited to any particular refrigerant, and a number of different refrigerants from a number of different classes or types of refrigerants is contemplated. These refrigerants have a phase change between a liquid and a gas at desired temperature ranges, which may be dictated by the environment in which the rotary heat engine is placed. The details relative to the phase change and operation is fully explained in the provisional application from which priority is claimed, and which provisional application is incorporated herein by reference in its entirety.

As noted in the provisional from which priority is claimed, a number of different configurations are contemplated for each of the central crankshaft, the radial cylinder coupling, the cylinder assemblies and the heat exchanger assembly. The central crankshaft can be positioned so that the axis of rotation is vertical, horizontal or oblique to the vertical and the horizontal. Additionally, a number of different configurations and sizes for the cylinder assembly are contemplated, as well as a number of different quantities of cylinder assemblies.

Finally, a number of different configurations are contemplated for (as well as sources of) the source of heat for the heat region and the source of cooling for the cooled region. A number of these are set forth in the incorporated by reference provisional application, and the disclosure is not limited to any such sources. With the desire to create a difference in temperature between the heat region and the cooled region, it will be understood to one of ordinary skill in the art that such sources may comprise any number of different sources, limited perhaps by the availability of such sources.

It has been determined that, preferably, an odd number of cylinder members be utilized. In particular, as an odd number, only a single cylinder will be transitioning between the hot and cooled regions of the system at a given time. This places less stress on the system because only one cylinder assembly is required to overcome the barrier between hot and cold at a time. Where there is an even number of cylinder assemblies, in most configurations, one cylinder assembly will be transitioning from the cold region of the system to the hot region while another cylinder is transitioning from the hot region of the system to the cold region of the system. Of course, the system is not limited to such a configuration, however, it has been found that such a configuration has benefits.

Furthermore, regardless of the configuration, a consideration is the minimization of liquid refrigerant entering into the cylinder assembly. There are a number of efficiency reasons, and operational reasons for maintaining the liquid refrigerant within the inner chamber of the heat exchanger body. First, less liquid refrigerant will be available in the inner chamber of the heat exchanger which limits the amount that is available for phase change to a gas, thereby reducing efficiency. Additionally, at some point, if sufficient amounts of liquid refrigerant pass into the cylinder assembly, there will not be sufficient remaining refrigerant to gasify and to provide sufficient pressure to move the piston relative to the cylinder member, thereby causing the cylinder to cease operating, which, eventually, if the same occurs in other cylinder assemblies, leads to the rotary heat engine failing to operate.

With reference to FIGS. 6 and 7, with a horizontally positioned cylinder assembly (i.e., when the central crankshaft is positioned substantially vertically or predominantly vertically), the heat exchanger body 90 can be positioned below the cylinder assembly, and relying on gravity to maintain the liquid refrigerant within the heat exchanger body, while allowing the gas refrigerant to pass through the connecting pipe and into the cylinder assembly.

In a vertical position (i.e., when the central crankshaft is positioned substantially horizontally or predominantly horizontally), the level of refrigerant preferably remains below the heat exchanger end 97 of the connecting pipe 92 in each position along the path of movement. For example, and with reference to FIG. 8 at the top of the cylinder assembly position, the liquid refrigerant remains below the heat exchanger end 97 of the connecting pipe, thereby relying on gravity to maintain the liquid refrigerant within the heat exchanger. With reference to FIG. 9, as the cylinder assembly approaches and reaches a horizontal orientation, due to the configuration of the heat exchanger body and the connecting pipe, the liquid refrigerant remains below the heat exchanger end of the connecting pipe, again maintaining the liquid refrigerant within the heat exchanger body.

Figure 10A:
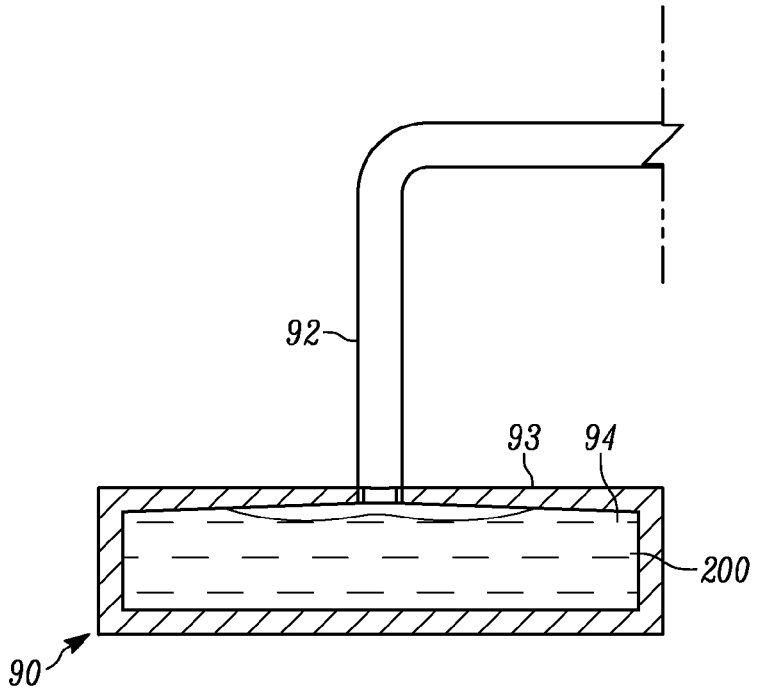
FIGS. 10*a* and 10*b* comprise cross-sectional views of the heat exchanger, showing thinner regions proximate the boundary of the liquid refrigerant and the gaseous refrigerant, thereby increasing heat transfer to that portion of the liquid refrigerant.
Figure 10B:
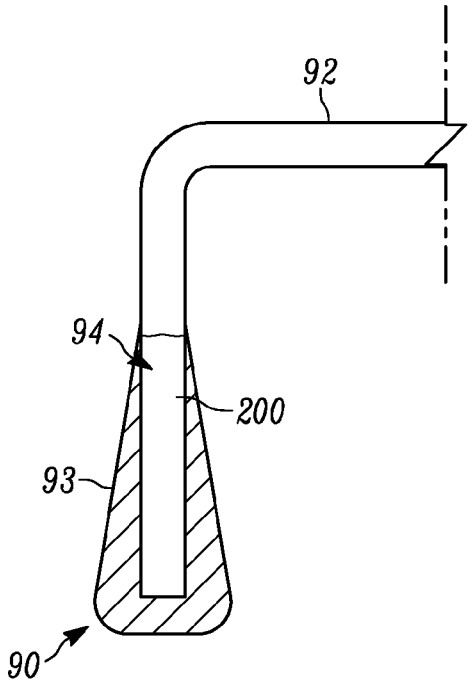

It is further contemplated that the structure of the heat exchanger body can be varied so as to favor the greatest exchange of heat to the refrigerant that is closest to the connecting pipe to boil first and to change phase to a gas phase. One manner in which to achieve the same, and with reference to FIGS. 10*a* and 10*b*, is to decrease wall thickness of the heat exchanger body proximate the connecting pipe, and to increase the wall thickness of the heat exchanger body away from the connecting pipe. In that manner, substantially even heating of the heat exchanger body will result in the greatest transfer of heat to the portion of the liquid refrigerant that is closest to the connecting pipe. A number of different configurations are contemplated and other manners are also considered, such as varying the material from which the heat exchanger is made along the body thereof, so that greater heat transfer occurs closer to the connecting pipe, to, in turn, heat up the liquid refrigerant closest to the connecting pipe the fastest.

As set forth above, the insulative nature of the rolling diaphragm, as well as the additional insulation that can be applied to the cylinder minimizes the conduction and/or transfer of heat to and from the gas refrigerant and to and from the outside environment. It will be understood that a refrigerant, such as the refrigerants set forth above, by its very nature will generally condense at the coldest location. It will be understood that for approximately half of the operation of the system, the cylinder assembly has heat applied, and for approximately half of the operation of the system, the cylinder assembly has heat removed. Thus, it is most advantageous to heat the heat exchanger assembly, and not the surrounding structures. In fact, energy is generally wasted heating elements other than the heat exchanger assembly. In some configurations, gas refrigerant within the cylinder assembly can condense, leading to excess liquid refrigerant within the cylinder assembly. This may cause the cylinder assembly to cease operating, and, eventually, the engine to cease operating.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A rotary heat engine comprising:

a central crankshaft having a first end and a second end and defining an axis of rotation, the central crankshaft further including at least one piston attachment member having an offset axis which is offset from the axis of rotation, with at least one axially displaced coupling point about the offset axis;

a plurality of cylinder assemblies, at least one cylinder assembly including:

a cylinder member having an elongated structure defining a bore and including a top end and a bottom end, the cylinder member rotatably positioned about the central crankshaft so as to rotate about the axis of rotation, the cylinder member further including an opening proximate the top end;

a piston member slidably positionable within the bore;

a connecting rod having a piston coupling end coupled to the piston member and a distal end coupled to the at least one axially displaced coupling point of the at least one piston attachment member; and a rolling diaphragm positioned between the piston and the top end so as to define a working volume therebetween, the rolling diaphragm having a top end, a bottom panel and an elongated portion, the top end being sealingly attached to the cylinder member proximate the top end and in fluid communication with the opening therein, with the bottom panel overlying the piston so that movement of the piston rolls the elongated portion of the rolling diaphragm over itself between the piston and the bore of the cylinder member; and a heat exchanger assembly associated with the at least one cylinder assembly including:

a heat exchanger body having an outer surface and an inner chamber, the heat exchanger body having a refrigerant positioned within the inner chamber;

a connecting pipe having an inner bore, a heat exchanger end and a cylinder member end, the heat exchanger end coupled to the heat exchanger body, and the cylinder member end coupled to the opening in the cylinder member, thereby placing the inner chamber in fluid communication with the opening of the cylinder member, and the working volume of the rolling diaphragm through the opening.

2. The rotary heat engine of claim 1 wherein at least a portion of the inner chamber of the heat exchanger body remains below the opening in the cylinder member, to in turn, preclude the passage of at least some refrigerant in a liquid state from the inner chamber to the working volume.

3. The rotary heat engine of claim 2 wherein the at least a portion of the inner chamber of the heat exchanger body that remains below the opening in the cylinder member is larger than a volume of refrigerant in a liquid state within the inner chamber.

4. The rotary heat engine of claim 1 wherein the heat exchanger body comprises a first material and the connecting pipe comprises a second material, with the first material being more conductive to heat than the second material.

5. The rotary heat engine of claim 1 wherein the heat exchanger body is configured to transfer heat faster the closer the liquid refrigerant is to the heat exchanger end of the connecting pipe.

6. The rotary heat engine of claim 1 wherein the cylinder member further comprises a distal end wall at the top end of the elongated structure, with the top end of the rolling diaphragm being sandwiched between the distal end wall and the top end of the elongated structure in sealed engagement, and wherein the opening of the cylinder member extends through the distal end wall.

7. The rotary engine of claim 6 wherein the rolling diaphragm comprises a neoprene material.

8. The rotary engine of claim 6 wherein the distal end wall includes an insulation member positioned on an inner surface thereof.

9. The rotary engine of claim 6 further comprising insulation positioned over at least a portion of an outer surface of the distal end wall and at least a portion of an outer surface of the elongated member.

10. The rotary engine of claim 1 wherein the piston member is smaller than the bore such that when the rolling diaphragm is positioned between the piston member and the bore of the cylinder member, the piston member is capable of pivoting relative to the bore, to, in turn, allow the connecting rod to pivot relative to the bottom end of the elongated structure of the cylinder member.

11. The rotary engine of claim 10 wherein the piston coupling end is rigidly coupled to an outer surface of the piston.

12. The rotary engine of claim 1 wherein the piston member of at least one of the plurality of cylinder assemblies is fixed to the respective at least one coupling point to preclude relative rotation therebetween.

13. The rotary engine of claim 1 wherein each of the plurality of cylinder assemblies is substantially identical, with one of the plurality of cylinder assemblies being fixed to the respective at least one coupling point to preclude relative rotation therebetween.

14. The rotary engine of claim 1 further comprising a radial cylinder coupling that is rotatably fixed to the central crankshaft so as to rotate about the axis of rotation, with each of the plurality of cylinder.

15. The rotary engine of claim 1 wherein each of the plurality of cylinder assemblies are maintained in a same plane, which plane is perpendicular to the axis of rotation.

16. The rotary engine of claim 1 wherein the plurality of cylinder assemblies comprises an uneven number of cylinder assemblies, spaced substantially uniformly about the piston attachment member.

* * * * *